US011810733B1

(12) United States Patent
Tsai et al.

(10) Patent No.: US 11,810,733 B1
(45) Date of Patent: Nov. 7, 2023

(54) KEY STRUCTURE

(71) Applicant: Primax Electronics Ltd., Taipei (TW)

(72) Inventors: Sheng-An Tsai, Taipei (TW); Chun-Che Wu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/973,196

(22) Filed: Oct. 25, 2022

(30) Foreign Application Priority Data

Sep. 28, 2022 (TW) ..... 111136849

(51) Int. Cl.

| | |
|---|---|
| ***H01H 13/52*** | (2006.01) |
| ***H01H 13/7065*** | (2006.01) |
| ***H01H 13/84*** | (2006.01) |
| ***H01H 3/12*** | (2006.01) |

(52) U.S. Cl.
CPC ..... *H01H 13/52* (2013.01); *H01H 3/125* (2013.01); *H01H 13/7065* (2013.01); *H01H 13/84* (2013.01); *H01H 2233/07* (2013.01)

(58) Field of Classification Search
CPC .. H01H 2235/004; H01H 13/00; H01H 13/14; H01H 13/20; H01H 13/28; H01H 13/50; H01H 13/52; H01H 13/70; H01H 13/7065; H01H 13/84; H01H 2221/058; H01H 2233/07; H01H 3/00; H01H 3/02; H01H 3/04; H01H 3/06; H01H 3/12; H01H 3/122; H01H 3/125; H01H 3/32; H01H 3/46; H01H 2221/00; H01H 2221/05; G05G 1/00; G05G 1/02
See application file for complete search history.

(56) References Cited

U.S. PATENT DOCUMENTS 11,177,084 B1 * 11/2021 Liu ..... H01H 3/125

FOREIGN PATENT DOCUMENTS

CN 114551138 A * 5/2022

* cited by examiner

*Primary Examiner* — Anthony R Jimenez
(74) *Attorney, Agent, or Firm* — KIRTON McCONKIE; Evan R. Witt

(57) ABSTRACT

A key structure includes a supporting frame, a keycap, a stabilizer bar and two flexible hooks. The supporting frame includes at least one supporting hook. The keycap is located over the supporting frame. The keycap includes two connecting parts. The stabilizer bar includes a transverse bar part and two branch bar parts. The transverse bar part is locked in the at least one supporting hook of the supporting frame. The two flexible hooks are arranged between the keycap and the stabilizer bar. Each of the two flexible hooks includes a coupling terminal and a hook part. Each of the two connecting parts of the keycap is detachably connected with the coupling terminal of the corresponding flexible hook. Each of the two branch bar parts of the stabilizer bar is locked in the hook part of the corresponding flexible hook.

9 Claims, 9 Drawing Sheets

KEY STRUCTURE

FIELD OF THE INVENTION

The present invention relates to an input device, and more particularly to a key structure of a keyboard device

BACKGROUND OF THE INVENTION

With increasing development of science and technology, a variety of electronic devices are designed in views of convenience and user-friendliness. For helping the users well operate the electronic devices, the electronic devices are gradually developed in views of humanization. The input devices of the common electronic devices include for example mouse devices, keyboard devices, trackball devices, or the like. Via the keyboard device, texts or symbols can be inputted into the computer system directly. As a consequence, most users and most manufacturers of input devices pay much attention to the development of keyboard devices.

A keyboard device comprises plural key structures. Generally, some of the plural key structures are relatively large in area and size. For example, in the large-sized key structure, the length is larger than the width. In order to allow the user to operate the keyboard device more flexibly, the large-sized key structure of the keyboard device is usually equipped with a stabilizer bar. Due to the arrangement of the stabilizer bar, the overall structural strength of the large-sized key structure is increased. The stabilizer bar is connected with plural hooks on a keycap of the key structure. Consequently, the keycap can be moved upwardly or downwardly relative to a base plate through the stabilizer bar, and the keycap can be kept stable and not inclined while the keycap is moved upwardly or downwardly.

However, the conventional large-sized key structure still has some drawbacks. For example, after the stabilizer bar is connected with the plural hooks of the keycap, there is a gap between the stabilizer bar and the keycap. Consequently, while the keycap is moved upwardly or downwardly relative to the base plate, the friction or impact between the stabilizer bar and the hooks of the keycap is readily generated. Under this circumstance, the unpleasant noise is generated.

Therefore, there is a need of providing an improved mouse device in order to overcome the drawbacks of the conventional technologies.

SUMMARY OF THE INVENTION

An object of the present invention provides a key structure with the function of reducing noise.

The other objects and advantages of the present invention will be understood from the disclosed technical features.

In accordance with an aspect of the present invention, a key structure is provided. The key structure includes a supporting frame, a keycap, a stabilizer bar and two flexible hooks. The supporting frame includes at least one supporting hook. The keycap is located over the supporting frame. The keycap includes two connecting parts. The two connecting parts are respectively located at two opposite sides of the keycap. The stabilizer bar is arranged between the supporting frame and the keycap. The stabilizer bar includes a transverse bar part and two branch bar parts. The two branch bar parts are respectively located at two ends of the transverse bar part. The transverse bar part is locked in the at least one supporting hook of the supporting frame. An extending direction of the transverse bar part and an extending direction of each of the two branch bar parts are different. The two flexible hooks are arranged between the keycap and the stabilizer bar. Each of the two flexible hooks includes a coupling terminal and a hook part. Each of the two connecting parts of the keycap is detachably connected with the coupling terminal of the corresponding flexible hook. Each of the two branch bar parts of the stabilizer bar is locked in the hook part of the corresponding flexible hook.

In an embodiment, while the keycap is moved upwardly or downwardly relative to the supporting frame, the branch bar parts of the stabilizer bar are moved with the keycap through the corresponding flexible hooks and moved in a direction away from or toward the supporting frame.

In an embodiment, the keycap further includes a plunger body. The plunger body is arranged between the two connecting parts. Moreover, the plunger body is extended in a direction toward the supporting frame.

In an embodiment, the supporting frame further includes a hollow post. The hollow post is extended in a direction toward the keycap. The plunger body is disposed within the hollow post. While the keycap is moved upwardly or downwardly relative to the supporting frame, the plunger body is correspondingly moved within the hollow post of the supporting frame.

In an embodiment, the transverse bar part of the stabilizer bar is extended in a first direction, and the two branch bar parts of the stabilizer bar are extended in a second direction. The first direction and the second direction are perpendicular to each other.

In an embodiment, the coupling terminal of each flexible hook includes a wall body, a first protrusion wall and a second protrusion wall. The wall body has a first surface and a second surface opposed to the first surface. The first protrusion wall is protruded from the first surface of the wall body. The second protrusion wall is protruded from the second surface of the wall body. The wall body, the first protrusion wall and the second protrusion wall are collaboratively formed as a cross-shaped upper portion of the coupling terminal.

In an embodiment, the coupling terminal of each flexible hook further includes a first engaging structure, a second engaging structure and a third engaging structure. The first engaging structure is installed on an end surface of the first protrusion wall away from the first surface of the wall body. The second engaging structure and the third engaging structure are installed on the second surface of the wall body. The second protrusion wall is arranged between the second engaging structure and the third engaging structure.

In an embodiment, each connecting part of the keycap includes an accommodation space, a first engaging recess, a second engaging recess and a third engaging recess. The first engaging recess, the second engaging recess and the third engaging recess are in communication with the accommodation space. When the coupling terminal of each flexible hook is detachably connected with the corresponding connecting part of the keycap, the wall body, the first protrusion wall and the second protrusion wall are disposed within the accommodation space of the corresponding connecting part, and the first engaging structure, the second engaging structure and the third engaging structure are respectively disposed within the first engaging recess, the second engaging recess and the third engaging recess.

In an embodiment, the flexible hooks are made of elastic material.

From the above descriptions, the present invention provides the key structure. The flexible hooks made of the elastic material are used to clamp the branch bar parts at the two ends of the stabilizer bar. While the stabilizer bar is moved with the keycap and the branch bar parts of the stabilizer bar knock on the inner peripheries of the corresponding flexible hooks, no obvious sound is generated. Consequently, the purpose of effectively reducing the noise is achieved. The flexible hooks also provides a buffering effect. Consequently, while the branch bar parts of the stabilizer bar are moved and the branch bar parts of the stabilizer bar knock on the corresponding flexible hooks, no violent vibration is generated. In other words, tactile feel is not adversely affected. Moreover, the flexible hook of the present invention can be applied to various key structures with different travel distances. The special structural design is helpful to the increase of the automatic producing and assembling efficiency.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
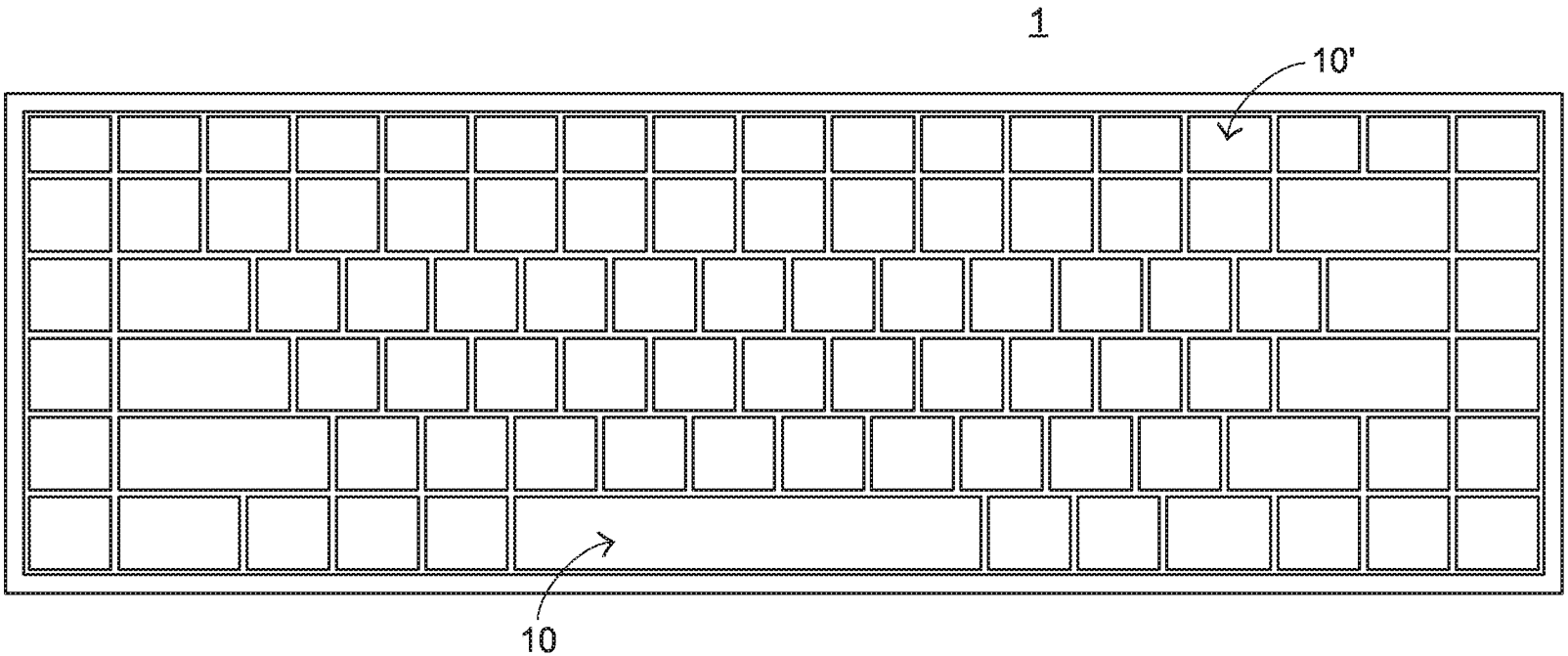
FIG. 1 is a schematic top view illustrating the outer appearance of a keyboard device according to an embodiment of the present invention.
Figure 2:
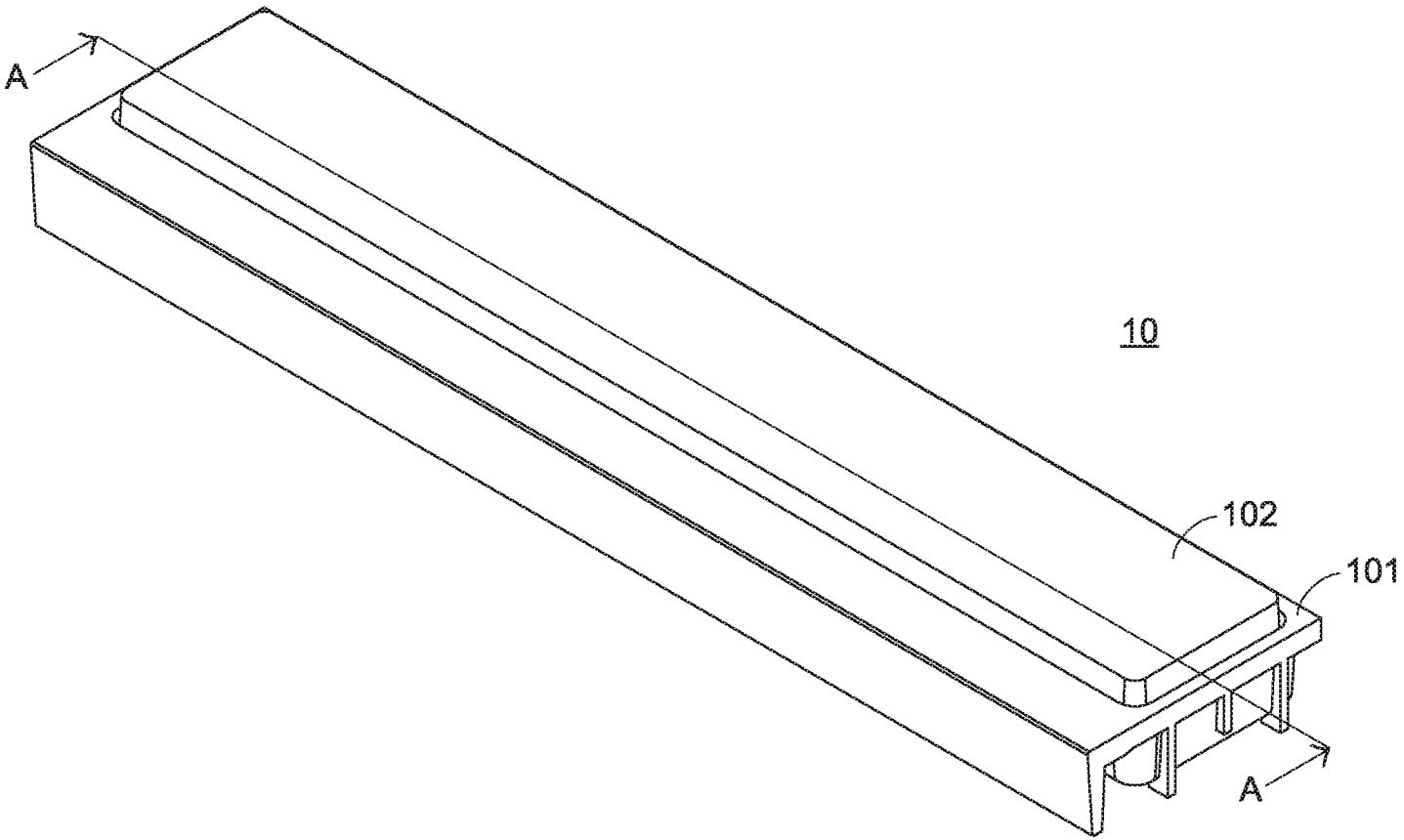
FIG. 2 is a schematic perspective view illustrating a key structure of the keyboard device as shown in FIG. 1.
Figure 3:
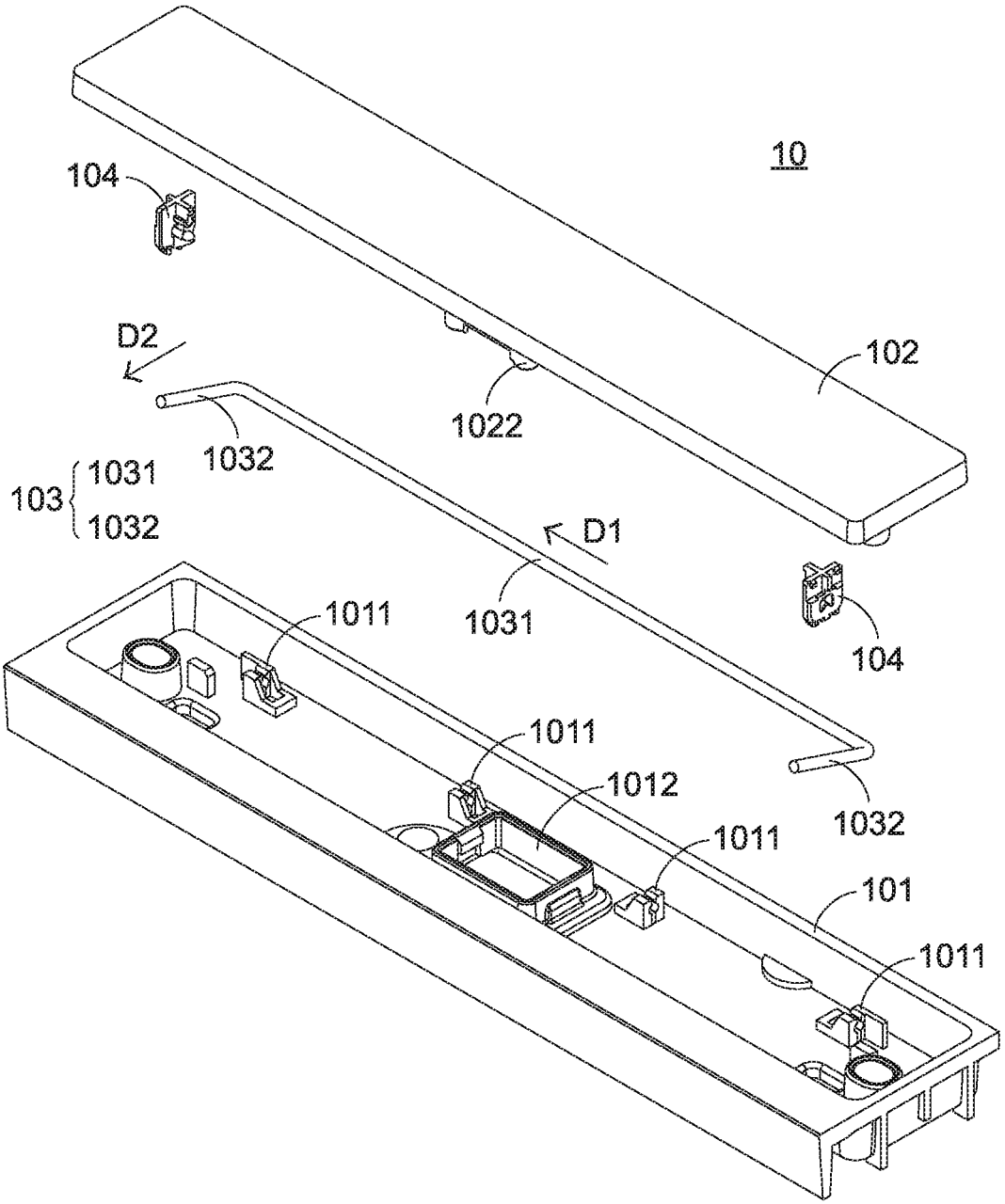
FIG. 3 is a schematic exploded view illustrating the key structure as shown in FIG. 2 and taken along a viewpoint.
Figure 5:
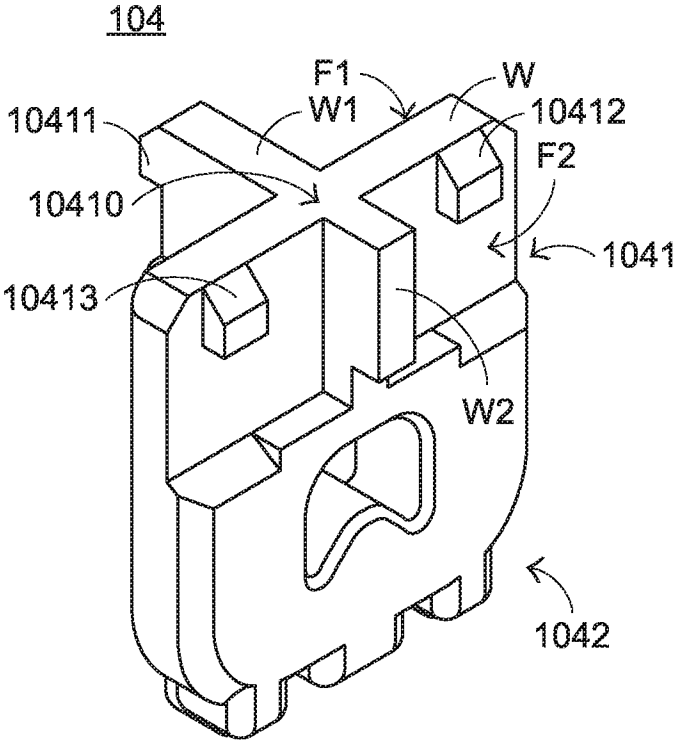
FIGS. 4 and 5 are schematic enlarged views illustrating the flexible hook as shown in FIG. 3 and taken from different viewpoints.
Figure 4:
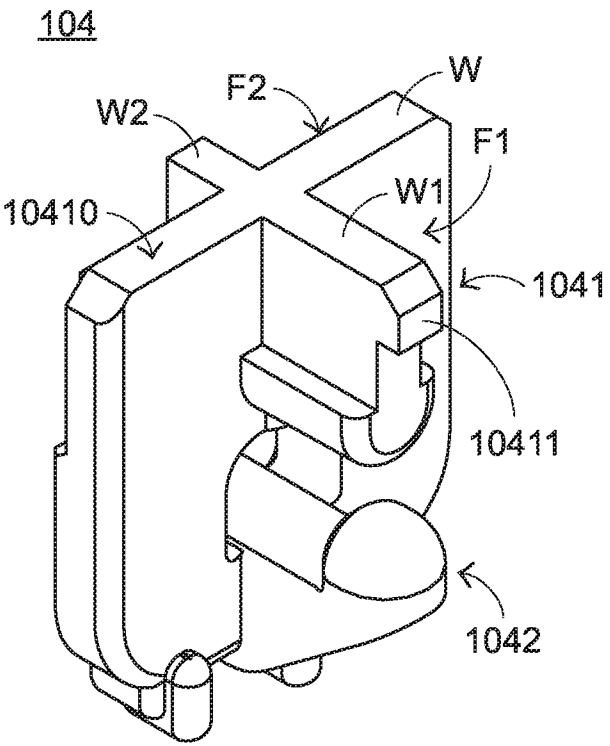
Figure 6:
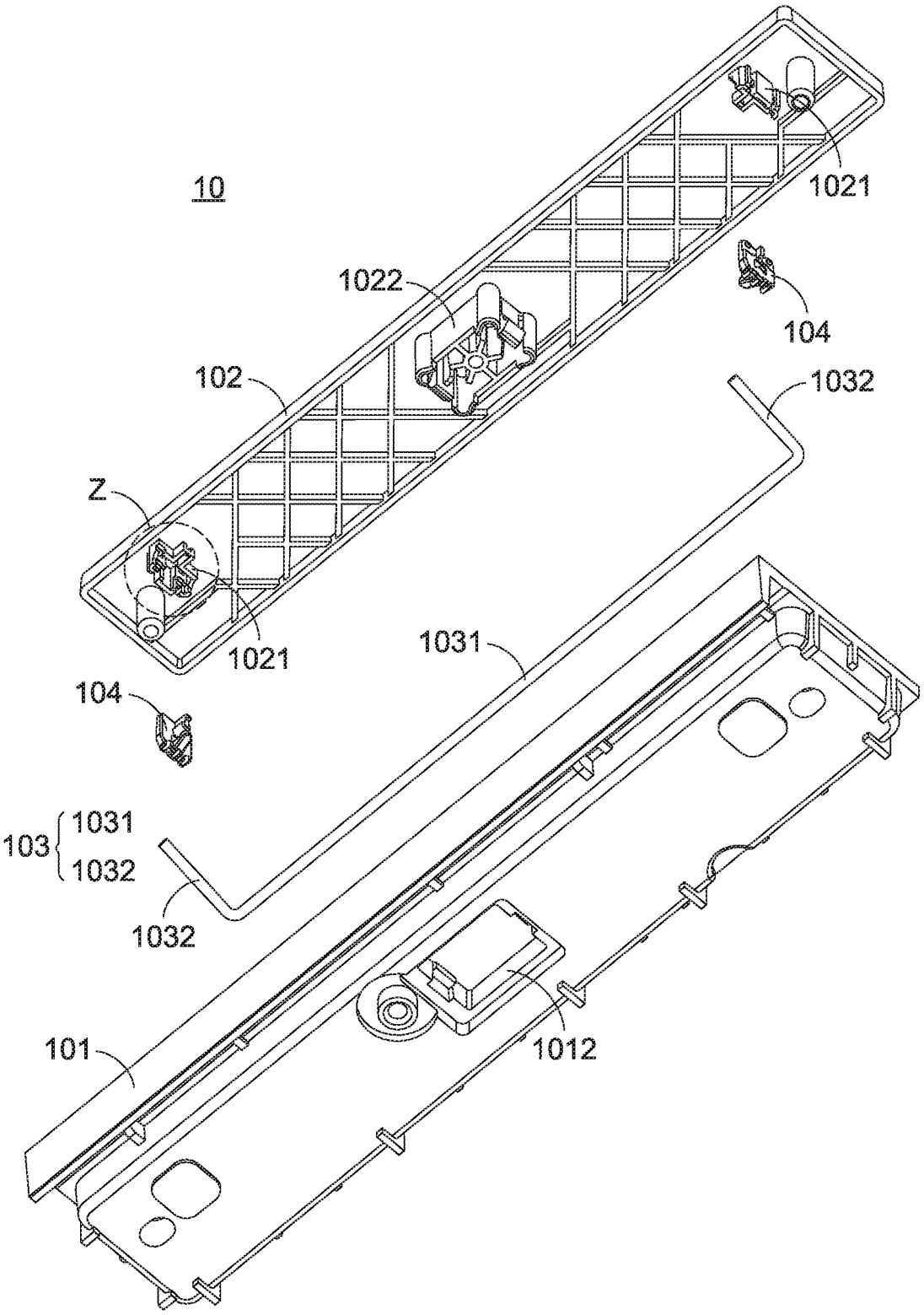
FIG. 6 is a schematic exploded view illustrating the key structure as shown in FIG. 2 and taken along another viewpoint.
Figure 7:
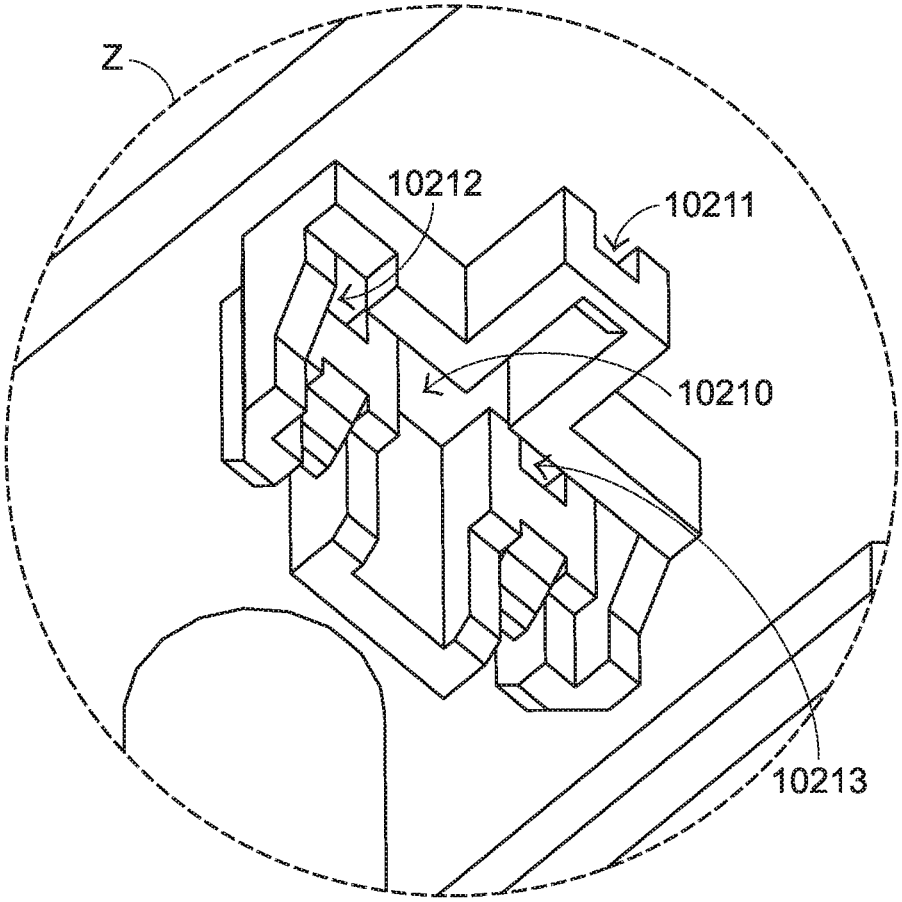
FIG. 7 is a schematic enlarged view illustrating a region Z of the key structure as shown in FIG. 6.
Figure 8:
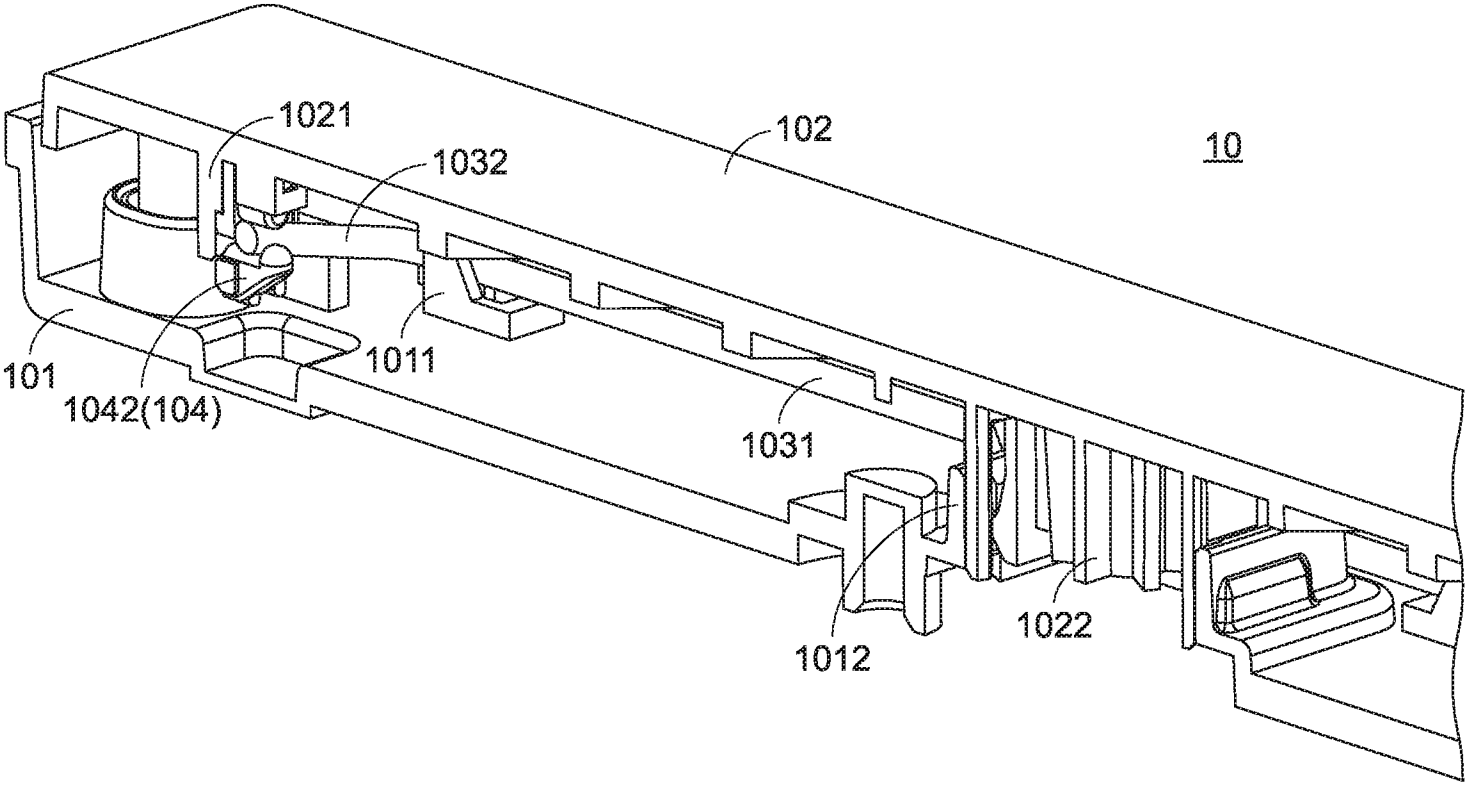
FIG. 8 is a schematic cutaway view illustrating the key structure as shown in FIG. 2 and taken along the line AA.
Figure 9:
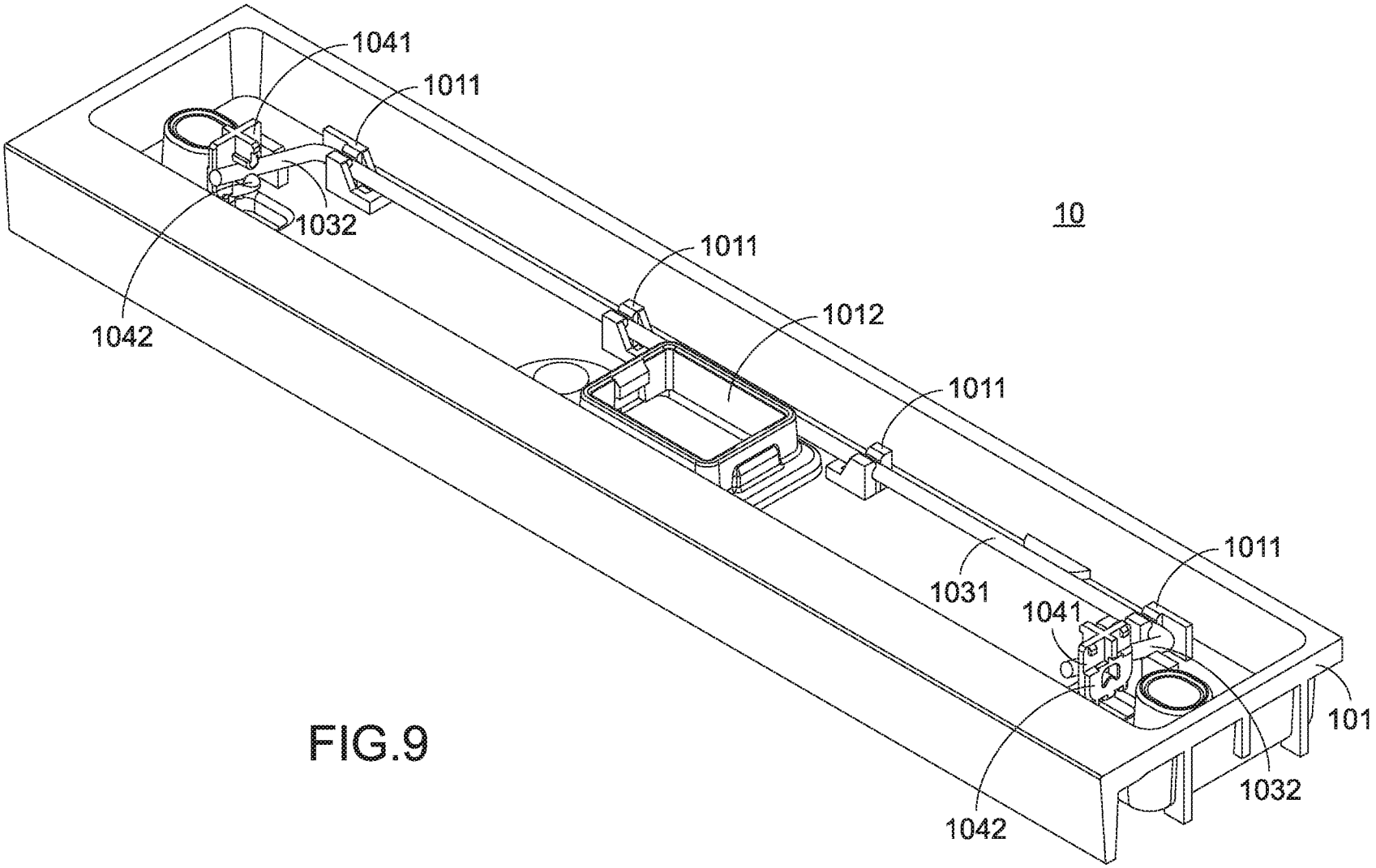
FIG. 9 is a schematic perspective view illustrating a portion of the key structure as shown in FIG. 2, in which some components are not shown.
Figure 10:
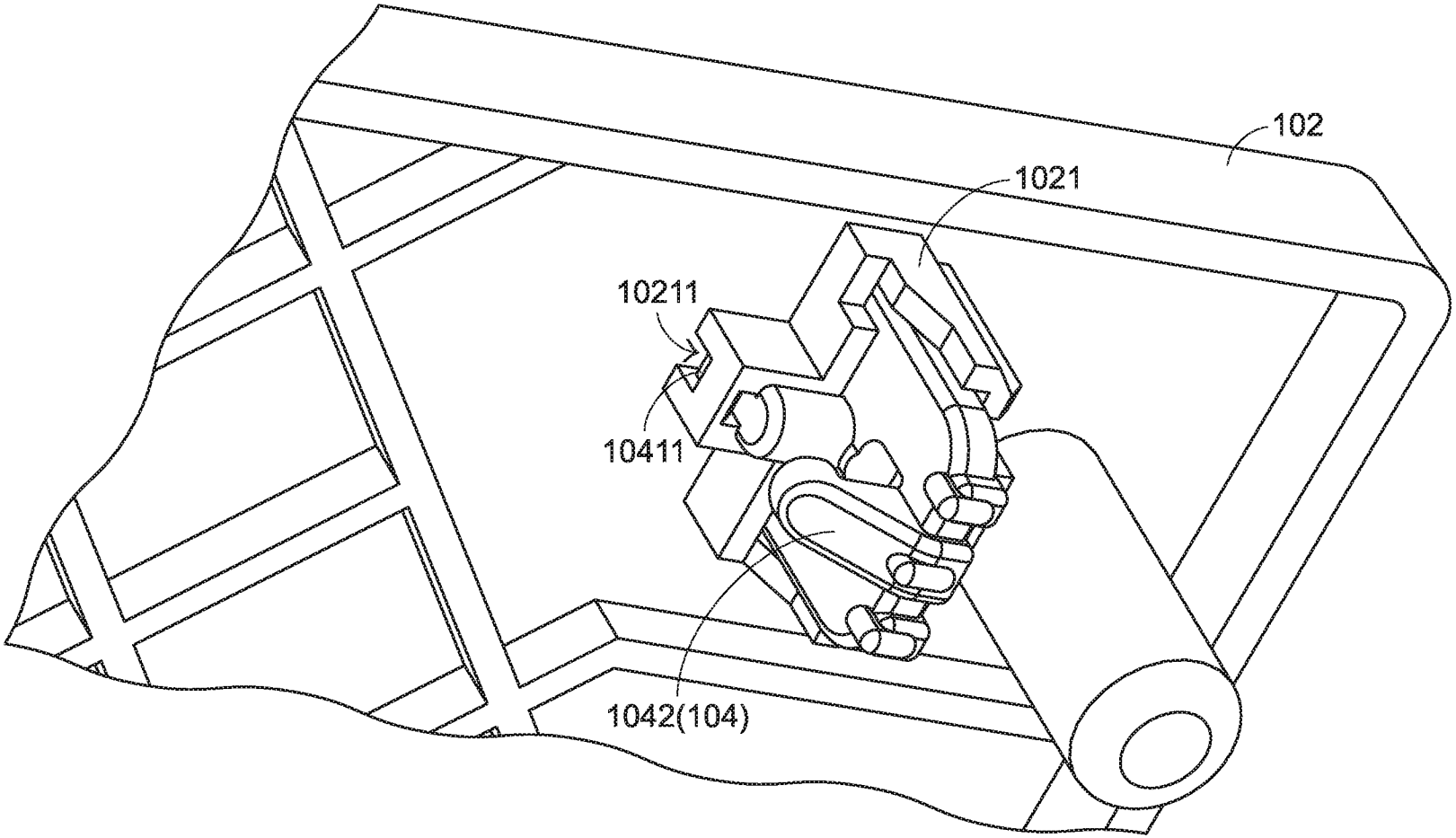
FIG. 10 is a schematic exploded view illustrating the combination of the flexible hook and the keycap of the key structure according to the embodiment of the present invention.

Please refer to FIGS. 1 to 10. FIG. 1 is a schematic top view illustrating the outer appearance of a keyboard device according to an embodiment of the present invention. FIG. 2 is a schematic perspective view illustrating a key structure of the keyboard device as shown in FIG. 1. FIG. 3 is a schematic exploded view illustrating the key structure as shown in FIG. 2 and taken along a viewpoint. FIGS. 4 and 5 are schematic enlarged views illustrating the flexible hook as shown in FIG. 3 and taken from different viewpoints. FIG. 6 is a schematic exploded view illustrating the key structure as shown in FIG. 2 and taken along another viewpoint. FIG. 7 is a schematic enlarged view illustrating a region Z of the key structure as shown in FIG. 6. FIG. 8 is a schematic cutaway view illustrating the key structure as shown in FIG. 2 and taken along the line AA. FIG. 9 is a schematic perspective view illustrating a portion of the key structure as shown in FIG. 2, in which some components are not shown. FIG. 10 is a schematic exploded view illustrating the combination of the flexible hook and the keycap of the key structure according to the embodiment of the present invention.

As shown in FIG. 1, the keyboard device 1 comprises plural key structures 10 and 10'. The key structures 10' are classified into some types, e.g., ordinary keys, numeric keys and function keys. When one of the key structures 10' is depressed by the user's finger, the keyboard device 1 generates a corresponding key signal to a computer (not show), and thus the computer executes a function corresponding to the depressed key structure. For example, when an ordinary key is depressed, a corresponding English letter or symbol is inputted into the computer. When a numeric key is depressed, a corresponding number is inputted into the computer. In addition, the function keys (F1-F12) can be programmed to provide various quick access functions. The key structure 10 is a Space key, a Shift key or any other similar multiple key with the larger area and length.

In the following embodiment, a portion of the keyboard device 1 will be described. Particularly, the key structure 10 of the keyboard device 1 will be described in the following drawings. For succinctness, only one key structure 10 and related components are shown in the drawings.

Please refer to FIGS. 2 to 10. In this embodiment, the key structure 10 comprises a supporting frame 101, a keycap 102, a stabilizer bar 103 and two flexible hooks 104.

The supporting frame 101 comprises at least one supporting hook 1011. In this embodiment, the at least one supporting hook 1011 of the supporting frame 101 includes four supporting hooks 1011. It is noted that the number of the at least one supporting hook 1011 is not restricted.

The keycap 102 is located over the supporting frame 101. The keycap 102 comprises two connecting parts 1021. The two connecting parts 1021 are respectively located at two opposite sides of the keycap 102. Moreover, the two connecting parts 1021 are installed on an inner surface of the keycap 102 and extended in the direction toward the supporting frame 101.

The stabilizer bar 103 is arranged between the supporting frame 101 and the keycap 102. The stabilizer bar 103 comprises a transverse bar part 1031 and two branch bar parts 1032. The two branch bar parts 1032 are respectively located at two ends of the transverse bar part 1031. The transverse bar part 1031 of the stabilizer bar 103 is locked in the supporting hooks 1011 of the supporting frame 101. The extending direction of the transverse bar part 1031 and the extending direction of the branch bar parts 1032 are different.

The two flexible hooks 104 are arranged between the keycap 102 and the stabilizer bar 103. Each flexible hook 104 comprises a coupling terminal 1041 and a hook part 1042. The connecting parts 1021 of the keycap 102 are detachably connected with the coupling terminals 1041 of the corresponding flexible hooks 104. The branch bar parts 1032 of the stabilizer bar 103 are locked in the hook parts 1042 of the corresponding flexible hooks 104.

While the keycap 102 is moved upwardly or downwardly relative to the supporting frame 101, the branch bar parts 1032 of the stabilizer bar 103 are moved with the keycap 102 through the corresponding flexible hooks 104 and moved in the direction away from or toward the supporting frame 101. Moreover, while the keycap 102 is moved upwardly or downwardly relative to the supporting frame 101, the transverse bar part 1031 of the stabilizer bar 103 is rotated within the supporting hooks 1011 of the supporting frame 101. Moreover, in this embodiment, the flexible hooks 104 are made of elastic material. Consequently, while the branch bar parts 1032 of the stabilizer bar 103 are moved with the keycap 102 through the corresponding flexible hooks 104 and the branch bar parts 1032 of the stabilizer bar 103 knock on the inner peripheries of the corresponding flexible hooks 104, no obvious sound is generated. In other words, the purpose of effectively reducing the noise is achieved. The plural flexible hooks 104 also provides a buffering effect. Consequently, while the branch bar parts 1032 of the stabilizer bar 103 are moved and the branch bar parts 1032 of the stabilizer bar 103 knock on the corresponding flexible hooks 104, no violent vibration is generated. In other words, the tactile feel is not adversely affected.

Moreover, while the keycap 102 is moved upwardly or downwardly relative to the supporting frame 101, the branch bar parts 1032 at the two ends of the stabilizer bar 103 are the sites that have the largest movement offset and are prone to the generate the noise. In accordance with a feature of the present invention, the flexible hooks 104 are used to clamp the branch bar parts 1032 of the corresponding stabilizer bar 103. The uses of the flexible hooks 104 to suppress sound can be the most effective and intuitive design to achieve the purpose of noise reduction. The actual experiments indicate that the uses of the flexible hooks 104 to clamp the branch bar parts 1032 of the corresponding stabilizer bar 103 can significantly reduce noise by more than 25%.

The other structures of the key structure 10 will be described in more details as follows.

Please refer to FIGS. 2 to 9 again. In an embodiment, the keycap 102 further comprises a plunger body 1022. The plunger body 1022 is arranged between the two connecting parts 1021. The plunger body 1022 is extended in the direction toward the supporting frame 101. Moreover, the supporting frame 101 further comprises a hollow post 1012. The hollow post 1012 is extended in the direction toward the keycap 102. The plunger body 1022 of the keycap 102 is disposed within the hollow post 1012. While the keycap 102 is moved upwardly or downwardly relative to the supporting frame 101, the plunger body 1022 is correspondingly moved within the hollow post 1012 of the supporting frame 101.

Please refer to FIGS. 3 to 9. In an embodiment, the transverse bar part 1031 of the stabilizer bar 103 is extended in a first direction D1, and the branch bar parts 1032 at the two opposite sides of the transverse bar part 1031 are extended in a second direction D2. The first direction D1 and the second direction D2 are perpendicular to each other. In other words, the angle between the transverse bar part 1031 and each branch bar part 1032 of the stabilizer bar 103 is 90 degrees, and the transverse bar part 1031 and each branch bar part 1032 of the stabilizer bar 103 are perpendicular to each other.

Please refer to FIGS. 3 to 9 again. In an embodiment, the coupling terminal 1041 of each flexible hook 104 comprises a wall body W, a first protrusion wall W1 and a second protrusion wall W2. The wall body W has a first surface F1 and a second surface F2, which are opposed to each other. The first protrusion wall W1 is protruded from the first surface F1 of the wall body W. The second protrusion wall W2 is protruded from the second surface F2 of the wall body W. The wall body W, the first protrusion wall W1 and the second protrusion wall W2 are collaboratively formed as a cross-shaped upper portion 10410 of the coupling terminal 1041. Due to the cross-shaped upper portion 10410 of the flexible hook 104, the automatic producing and assembling efficiency is enhanced. For example, during the automatic producing and assembling process, the flexible hook 104 can be stably stood on a conveyor belt through the cross-shaped upper portion 10410. In the subsequent process, the flexible hook 104 can be directly aligned and assembled with the corresponding component.

In an embodiment, the coupling terminal 1041 of each flexible hook 104 further comprises a first engaging structure 10411, a second engaging structure 10412 and a third engaging structure 10413. The first engaging structure 10411 is installed on an end surface of the first protrusion wall W1 away from the first surface F1 of the wall body W. The second engaging structure 10412 and the third engaging structure 10413 are installed on the second surface F2 of the wall body W. In addition, the second protrusion wall W2 is arranged between the second engaging structure 10412 and the third engaging structure 10413.

Please refer to FIGS. 3 to 9 again. In an embodiment, each connecting part 1021 of the keycap 102 comprises an accommodation space 10210, a first engaging recess 10211, a second engaging recess 10212 and a third engaging recess 10213. The first engaging recess 10211, the second engaging recess 10212 and the third engaging recess 10213 are in communication with the accommodation space 10210. When the coupling terminal 1041 of each flexible hook 104 is detachably connected with the corresponding connecting part 1021 of the keycap 102, the wall body W, the first protrusion wall W1 and the second protrusion wall W2 of the coupling terminal 1041 of each flexible hook 104 are disposed within the accommodation space 10210 of the corresponding connecting part 1021. In addition, the first engaging structure 10411, the second engaging structure 10412 and the third engaging structure 10413 of the coupling terminal 1041 of each flexible hook 104 are respectively disposed within the first engaging recess 10211, the second engaging recess 10212 and the third engaging recess 10213 of the corresponding connecting part 1021 of the keycap 102. Consequently, each flexible hook 104 is fixed in the corresponding connecting part 1021.

As mentioned above, the flexible hooks 104 are detachably connected with the corresponding connecting parts 1021 of the keycap 102. That is, each flexible hook 104 can be detached from the corresponding connecting part 1021 of the keycap 102. After flexible hook 104 is detached from the corresponding connecting part 1021 of the keycap 102, the flexible hook 104 can be connected with another key structure (e.g., a key structure with a different travel distance) through the first engaging structure 10411, the second engaging structure 10412 and the third engaging structure 10413 of the coupling terminal 1041. Since the structure of the flexible hook 104 is specially designed, the flexible hook 104 can be applied to various key structures with different travel distances (e.g., 2.0 mm, 2.5 mm, 2.8 mm or 3.2 mm).

From the above descriptions, the present invention provides the key structure. The flexible hooks made of the elastic material are used to clamp the branch bar parts at the two ends of the stabilizer bar. While the stabilizer bar is moved with the keycap and the branch bar parts of the stabilizer bar knock on the inner peripheries of the corresponding flexible hooks, no obvious sound is generated. Consequently, the purpose of effectively reducing the noise is achieved. The flexible hooks also provides a buffering effect. Consequently, while the branch bar parts of the stabilizer bar are moved and the branch bar parts of the stabilizer bar knock on the corresponding flexible hooks, no violent vibration is generated. In other words, tactile feel is not adversely affected. Moreover, the flexible hook of the present invention can be applied to various key structures with different travel distances. The special structural design is helpful to the increase of the automatic producing and assembling efficiency.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A key structure, comprising:

a supporting frame comprising at least one supporting hook;

a keycap located over the supporting frame, wherein the keycap comprises two connecting parts, and the two connecting parts are respectively located at two opposite sides of the keycap;

a stabilizer bar arranged between the supporting frame and the keycap, and comprising a transverse bar part and two branch bar parts, wherein the two branch bar parts are respectively located at two ends of the transverse bar part, the transverse bar part is locked in the at least one supporting hook of the supporting frame, and an extending direction of the transverse bar part and an extending direction of each of the two branch bar parts are different; and two flexible hooks arranged between the keycap and the stabilizer bar, wherein each of the two flexible hooks comprises a coupling terminal and a hook part, wherein each of the two connecting parts of the keycap is detachably connected with the coupling terminal of the corresponding flexible hook, and each of the two branch bar parts of the stabilizer bar is locked in the hook part of the corresponding flexible hook.

2. The key structure according to claim 1, wherein while the keycap is moved upwardly or downwardly relative to the supporting frame, the branch bar parts of the stabilizer bar are moved with the keycap through the corresponding flexible hooks and moved in a direction away from or toward the supporting frame.

3. The key structure according to claim 1, wherein the transverse bar part of the stabilizer bar is extended in a first direction, and the two branch bar parts of the stabilizer bar are extended in a second direction, wherein the first direction and the second direction are perpendicular to each other.

4. The key structure according to claim 1, wherein the flexible hooks are made of elastic material.

5. The key structure according to claim 1, wherein the keycap further comprises a plunger body, wherein the plunger body is arranged between the two connecting parts, and the plunger body is extended in a direction toward the supporting frame.

6. The key structure according to claim 5, wherein the supporting frame further comprises a hollow post, wherein the hollow post is extended in a direction toward the keycap, and the plunger body is disposed within the hollow post, wherein while the keycap is moved upwardly or downwardly relative to the supporting frame, the plunger body is correspondingly moved within the hollow post of the supporting frame.

7. The key structure according to claim 1, wherein the coupling terminal of each flexible hook comprises a wall body, a first protrusion wall and a second protrusion wall, and the wall body has a first surface and a second surface opposed to the first surface, wherein the first protrusion wall is protruded from the first surface of the wall body, and the second protrusion wall is protruded from the second surface of the wall body, wherein the wall body, the first protrusion wall and the second protrusion wall are collaboratively formed as a cross-shaped upper portion of the coupling terminal.

8. The key structure according to claim 7, wherein the coupling terminal of each flexible hook further comprises a first engaging structure, a second engaging structure and a third engaging structure, wherein the first engaging structure is installed on an end surface of the first protrusion wall away from the first surface of the wall body, the second engaging structure and the third engaging structure are installed on the second surface of the wall body, and the second protrusion wall is arranged between the second engaging structure and the third engaging structure.

9. The key structure according to claim 8, wherein each connecting part of the keycap comprises an accommodation space, a first engaging recess, a second engaging recess and a third engaging recess, and the first engaging recess, the second engaging recess and the third engaging recess are in communication with the accommodation space, wherein when the coupling terminal of each flexible hook is detachably connected with the corresponding connecting part of the keycap, the wall body, the first protrusion wall and the second protrusion wall are disposed within the accommodation space of the corresponding connecting part, and the first engaging structure, the second engaging structure and the third engaging structure are respectively disposed within the first engaging recess, the second engaging recess and the third engaging recess.

* * * * *